United States Patent [19]

Taylor

[11] 4,305,374

[45] Dec. 15, 1981

[54] REMOVABLE FIREPLACE HEARTH FLOOR AND METHOD FOR USING SAME

[75] Inventor: Edwin E. Taylor, New London, Iowa

[73] Assignee: Vega Industries, Inc., Des Moines, Iowa

[21] Appl. No.: 51,528

[22] Filed: Jun. 25, 1979

[51] Int. Cl.[3] ..... F24B 13/02

[52] U.S. Cl. ..... 126/143; 126/121; 126/130; 126/203

[58] Field of Search ..... 126/143, 130, 203, 243, 126/144, 121, 120, 279; D23/94, 96, 133, 97

[56] References Cited

U.S. PATENT DOCUMENTS

| | | | |
|---|---|---|---|
| 520,591 | 5/1894 | Flood | 126/243 |
| 2,375,318 | 5/1945 | Mudgett | 126/143 |
| 2,821,975 | 2/1958 | Thulman | 126/130 X |
| 3,744,477 | 7/1973 | Andrews | 126/120 |

*Primary Examiner*—Larry Jones

*Attorney, Agent, or Firm*—Zarley, McKee, Thomte, Voorhees & Sease

[57] ABSTRACT

A factory-built fireplace having a refractory hearth floor which is supported from beneath only at the side and rear marginal edges, and is not physically connected to any fireplace structure other than a sheet metal cover plate which extends across and is supported by the front edge of the hearth. Thus, the hearth may be removed, in the event of cracking or for any other reason, and replaced simply be removing the hearth cover without disturbing other portions of the fireplace structure.

6 Claims, 5 Drawing Figures

REMOVABLE FIREPLACE HEARTH FLOOR AND METHOD FOR USING SAME

BACKGROUND OF THE INVENTION

The present invention relates to factory-built fireplaces and, more specifically, to fireplace constructions designed for ease of replacement of individual parts.

Among the more popular types of fireplace constructions are the so-called prefabricated or factory-built fireplaces which are usually shipped in a fully assembled condition, ready for permanent installation. The hearth and sometimes the rear wall of the firebox are formed of a cast refractory material in order to withstand the high heat commonly encountered, as well as the loads which must be supported by the hearth floor. Other portions of such fireplaces are entirely or chiefly of sheet metal.

In order to provide the cooling air necessary to maintain the exterior of the fireplace at acceptable levels, the hearth must be elevated from the underlying structure to form the required air passages. Hearth support structure commonly comprises a plurality of rigid beams or the like, extending from front to rear beneath the hearth, and/or other underlying support structure physically attached to the metal pan in which the refractory material is cast. U.S. Pat. Nos. 3,744,477, and 3,762,391 for example, include illustrations of common hearth supporting structure.

In the event of cracking or breakage of the refractory material, it is usually necessary to replace the hearth. In some factory-built fireplaces this has been altogether impractical and, in any case, is a difficult and time-consuming job. The principal object of the present invention is to provide a factory-built fireplace having structural features which permit simple and rapid removal and replacement of the refractory hearth.

Other objects will in part be obvious and will in part appear hereinafter.

SUMMARY OF THE INVENTION

In the fireplace construction of the invention, the hearth is formed from a refractory material which is poured while in a freshly mixed, semi-liquid condition, into a sheet metal pan and allowed to harden. The side and rear walls of the inner shell, or comparable portions of the fireplace structure, include inwardly directed, horizontal flanges along their lower edges. The hearth rests upon and is entirely supported by these flanges and its side and rear surfaces are in contact with, but unattached to, the side and rear walls of the inner fireplace shell.

The front hearth cover is attached in the usual manner to the front surface of the hearth pan and is also attached at its ends, which extend beyond the sides of the hearth pan, to the fireplace structure itself, thereby preventing forward movement of the hearth after installation. The lower edges of the sheet metal side and rear walls or liners of the firebox contact the upper hearth surface to prevent upward movement of the hearth and migration of ashes or other combustion products into the spaces beneath the hearth.

DETAILED DESCRIPTION OF THE INVENTION

Figure 1:
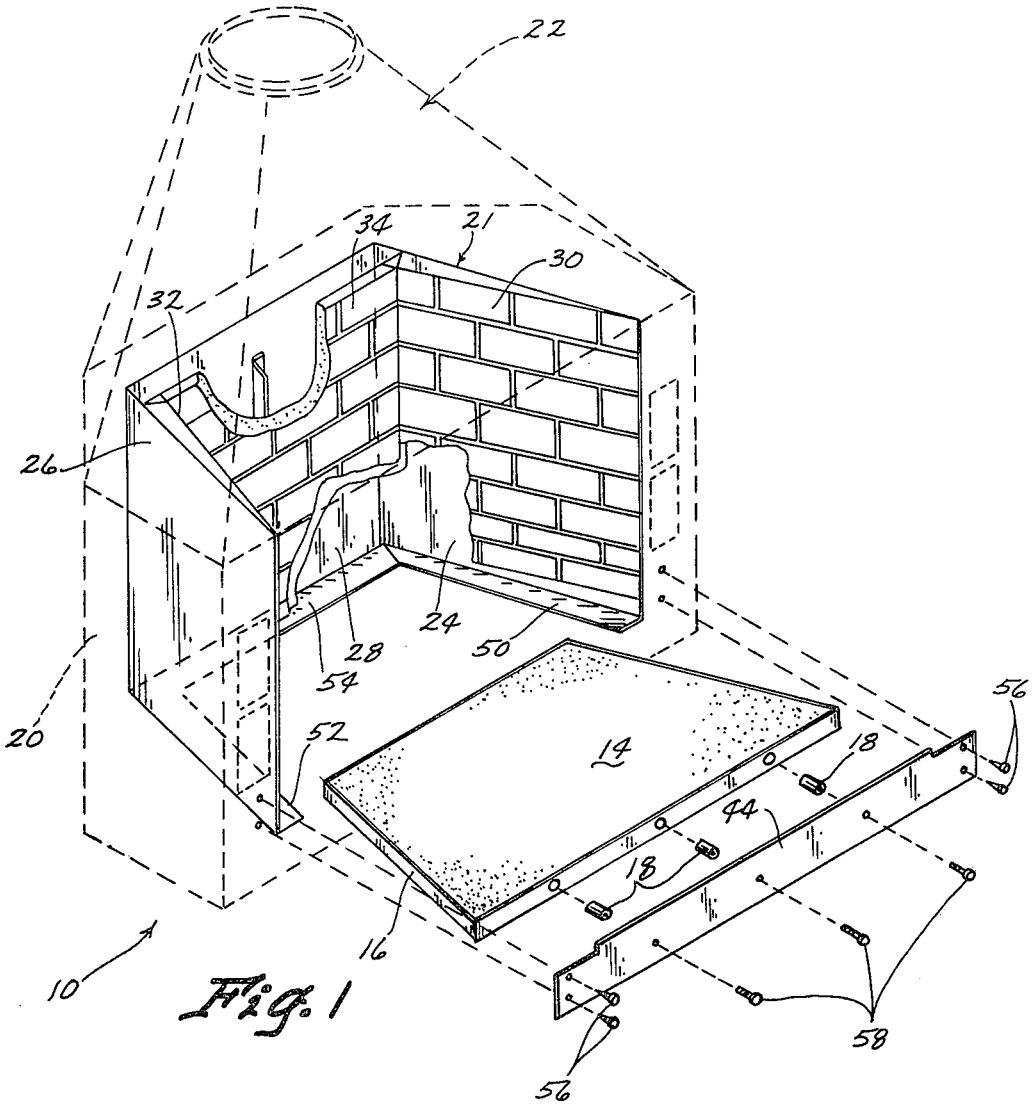
FIG. 1 is an exploded perspective view, with some portions broken away and others shown in phantom lines, of a fireplace structure embodying the invention.
Figure 2:
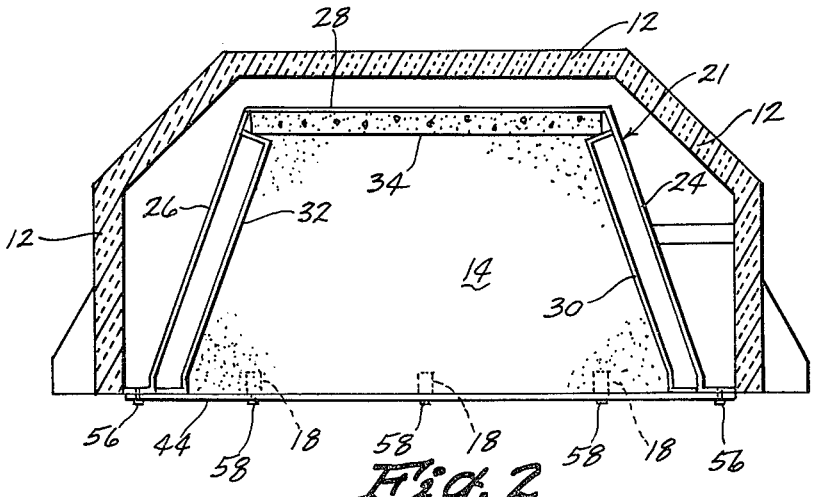
FIG. 2 is a plan view, partly in section, of the fireplace of FIG. 1.
Figures 3, 4, 5:
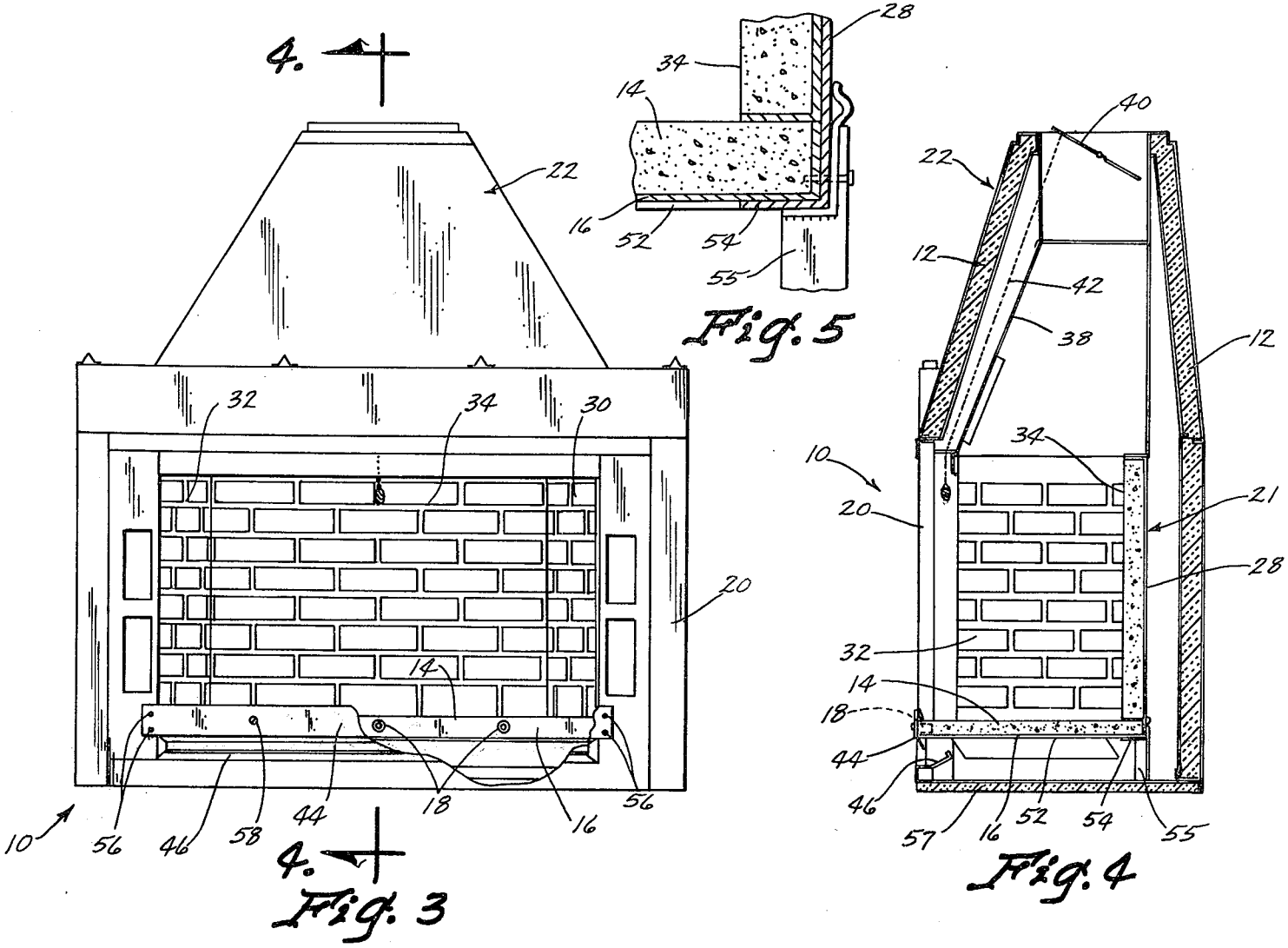
FIG. 3 is a front elevational view of the fireplace, with a portion broken away.
FIG. 4 is a side elevational view in section on the line 4—4 of FIG. 3.
FIG. 5 is an enlarged partial sectional view of the rear lower corner of the firebox.

In FIG. 1 is shown a typical factory-built fireplace unit, denoted generally by reference numeral 10, of the general type wherein the present invention is intended to be employed. Fireplace 10, as is typical of such units, is principally of sheet metal construction, the only significant exceptions being layers of conventional insulating material 12 (FIGS. 2 and 4) between the two outermost walls and hearth 14 which is a monolithic slab of refractory material. The slab may conveniently be formed to the desired dimensions and configuration by pouring the refractory material, while in a flowable condition, into a sheet metal hearth pan 16, formed for such purpose. Prior to pouring the refractory material into pan 16 and allowing it to harden, bushings 18 are inserted through holes in what becomes the front edge of the pan upon assembly of the hearth with the fireplace unit, thereby becoming a permanent part of the hearth.

The elements of the fireplace with which the present invention is most closely concerned are shown in solid lines in FIG. 1, outer enclosure 20 and upper hood 22 being outlined in phantom lines. An inner enclosure 21 is spaced inwardly from outer enclosure 20 and includes side walls 24 and 26 and rear wall 28. Spaced inwardly from the inner surfaces of walls 24, 26 are wing panels 30 and 32, respectively. These are generally parallel to and spaced from the corresponding walls 24, 26 of the inner shell 21, by virtue of flanges along their front and rear vertical edges. Because the wing panels are held in spaced relation to the inner shell side walls, they absorb the most intense heat on a separate, more easily replacement element rather than on the inner shell itself. The inwardly facing surfaces of the wing panels and rear liner may be plain, or, if desired, may be provided with an embossed brick pattern, as shown, for decorative effect and enhanced structural rigidity. A rear fire block 34 is mounted on the interior surface of rear wall 28 and is made of masonry or other fire resistant material similar to the material used for hearth 14.

Spaced inwardly within outer hood 22 is an inner hood 38 (FIG. 4), through which smoke and other products of combustion are led to a suitable chimney structure (not shown). Adjustable damper 40 is provided in the usual manner for movement by chain 42, having an end portion or handle manually accessible at the front of the fireplace. Upper and lower hearth covers 44 and 46, respectively, are attached to the lower front side of fireplace unit 10, as explained later in more detail, and cooperate to form an opening for entry of room air into the open space beneath hearth 14.

A pair of flanges 50 and 52 extend inwardly from the lower edges of inner shell side walls 24 and 26, respectively, being securely attached thereto or, preferably, formed integrally therewith. Likewise, flange 54 extends inwardly of the firebox, or forwardly of the fireplace unit, from the lower edge of inner shell rear wall 28. These three flanges serve as the entire underlying support for hearth slab 14 and pan 16. Accordingly, the width of inward extent of the flanges and the strength or load-bearing capacity of the material thereof are determined by the weight of the hearth.

A support bracket 55 engages flange 54 and supports it and shell 21 in spaced relation above an insulated pad 57. Other supports (not shown) similar to brackets 55 support flanges 50, 52 and shell 21 in rigid fashion above pad 57.

In assembly, the hearth is laid upon side flanges 50 and 52, and slid rearwardly until the rear edge of the hearth engages inner shell rear wall 28. The configuration and dimensions of the hearth side and rear edges correspond substantially to those of the inner shell walls, whereby the hearth side and rear edges engage the portions of the inner shell adjacent flanges 50, 52, and 54 when the hearth is in place. The lower edges of wing panels 30 and 32, and rear liner 34, are each spaced above the plane of flanges 50, 52 and 54 by a distance substantially equal to the thickness of hearth slab 14 and pan 16, whereby the lower edges of the firebox walls rest upon the upper surface of hearth 14 adjacent the marginal edges thereof.

After the hearth and other elements are in place, upper hearth cover is attached to the fireplace unit. The ends of the hearth cover extend past the edges of the front edge of hearth pan 16, which is entirely covered when hearth cover 44 is attached by screws 58 to the fireplace housing on each side, outwardly of the hearth. Cover 44 is also attached to the front of hearth 14 by screws 56, in order to hold the cover in snug contact with the hearth front. Screws 58 pass through openings formed for such purpose in hearth cover 44 for engagement in previously mentioned bushings 18.

From the foregoing, it is evident that the fireplace structure of the invention allows simple and rapid removal and replacement of the hearth without the necessity of disassembling and reassembling a number of elements to which accessibility is difficult after final installation of the fireplace unit. All that is required is to remove the upper hearth cover, by removing a few screws from the front of the unit, and slide the hearth forwardly. The new or repaired hearth may then be slid into place on the inner shell flanges and the hearth cover replaced. Although the hearth is not physically attached to the structure by which it is supported, it is restrained against sideward or rearward movement by the upper hearth cover which is affixed to the fireplace unit laterally of the front edge of the hearth. The wing panels and rear liner 30, 32, 34, having lower edges in substantially continuous contact with the upper surface of the hearth slab, prevent upward movement thereof. The wing panels and rear liner, together with the underlying flanges, effectively prevent migration of ashes or other combustion products into the space beneath the hearth.

What is claimed is:

1. A factory-built fireplace unit for permanent installation and enclosure as part of a structure, said unit comprising:

(a) an open front firebox having two side walls and one rear wall of sheet metal wherein said walls are contiguous;

(b) a hearth comprising a monolithic slab of refractory material having a peripheral configuration substantially corresponding at the sides and rear to that defined by the lower edges of said side and rear walls, and a straight front edge extending between said side walls;

(c) means supporting said hearth below the lower edges of said side walls, said supporting means consisting entirely of members extending beneath, but physically unattached to, said hearth, whereby the latter may be slidingly removed from said firebox without physical detachment from said supporting means; and (d) wherein the lower edges of each of said side and rear firebox walls are substantially in contiguous contact with the upper surface of the hearth inwardly of the side and rear edges thereof.

2. The invention according to claim 1 further including a sheet metal cover extending entirely across and past each end of the front edge of said hearth, in contact therewith, and means attaching said cover to said fireplace unit at points laterally spaced from said hearth.

3. The invention according to claim 1 wherein said hearth further comprises a sheet metal pan containing said slab.

4. The invention according to claim 3 and further including a front hearth cover extending entirely across said hearth front edge, in contact therewith.

5. The invention according to claim 4 wherein said hearth cover extends laterally past both sides of said hearth, and further including means attaching said hearth cover to said fireplace unit at points laterally spaced from said hearth.

6. A method for installing a hearth in a fireplace having a front face and having an open front firebox with opposite vertical side walls and a rear vertical wall said walls having horizontal flanges attached thereto and extending inwardly into said firebox adjacent to the lower edges of said walls, said hearth having a shape conforming substantially to the cross-sectional configuration of said side and rear walls, said method comprising:

inserting said hearth into said firebox in a horizontal position with some of the perimetric edges of said hearth in mating engagement with said side and rear walls whereby the lower edges of each of said side and rear firebox walls are substantially in continuous contact with the upper surface of said hearth inwardly of the side and rear edges thereof, and with a front perimetric edge of said hearth presented toward the open front of said firebox;

resting said hearth on said horizontal flanges attaching a cover plate to said front perimetric edge of said hearth;

attaching said cover plate to said front face of said fireplace.

* * * * *